US008186795B2

(12) United States Patent
Takahashi

(10) Patent No.: US 8,186,795 B2
(45) Date of Patent: May 29, 2012

(54) LIQUID DROPLET JETTING APPARATUS AND PROGRAM FOR CONTROLLING JETTING A LIQUID DROPLET

(75) Inventor: Yoshikazu Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 519 days.

(21) Appl. No.: 12/414,463

(22) Filed: Mar. 30, 2009

(65) Prior Publication Data

US 2009/0267978 A1 Oct. 29, 2009

(30) Foreign Application Priority Data

Apr. 28, 2008 (JP) ..... 2008-116618

(51) Int. Cl.
*B41J 2/205* (2006.01)
*B41J 29/38* (2006.01)

(52) U.S. Cl. ..... 347/15; 358/3.27; 358/3.07; 358/3.1; 347/14

(58) Field of Classification Search ..... 347/15, 347/14, 12; 358/3.27, 3.07, 3.1
See application file for complete search history.

(56) References Cited

U.S. PATENT DOCUMENTS

2005/0204365 A1* 9/2005 Imai ..... 719/321
2007/0211092 A1* 9/2007 Shingyohuchi et al. ..... 347/10

FOREIGN PATENT DOCUMENTS

JP 2003-145744 A 5/2003
JP 2005-205685 A 8/2005
JP 2005-225004 A 8/2005
JP 2007-098745 A 4/2007

OTHER PUBLICATIONS

Japan Patent Office; Notice of Reasons for Rejection in Japanese Patent Application No. 2008-116618 (counterpart to the above-captioned US Patent Application) mailed on Aug. 24, 2010.
Japan Patent Office, Notice of Reasons for Rejection for Japanese Patent Application No. 2010-238370 (counterpart to above-captioned patent application), mailed Feb. 21, 2012.

* cited by examiner

*Primary Examiner* — Julian Huffman
(74) *Attorney, Agent, or Firm* — Baker Botts L.L.P.

(57) ABSTRACT

A data generating circuit incorporated in an ASIC includes a first jetting mode memory circuit which stores information related to a plurality of first jetting modes, a time-sequence information memory circuit which stores time-sequence information of a jetting mode which associates one of the plurality of first jetting modes, for each jetting timing of the nozzle, a second jetting mode memory circuit which stores information related to a plurality of second jetting modes, which are more than types of the plurality of first jetting modes, and a jetting mode selecting circuit which selects a jetting mode at an arbitrary jetting timing among the plurality of second jetting modes, based on the first jetting modes at the arbitrary jetting timing and at least one of the previous and subsequent jetting timings.

9 Claims, 15 Drawing Sheets

Fig. 8

| FIRST JETTING MODE No. | TYPE OF LIQUID DROPLETS | VOLUME OF LIQUID DROPLETS (pl) |
|---|---|---|
| 0 | NIL | 0 |
| 1 | S (SMALL DROPLET) | 1.5 |
| 2 | M (MEDIUM DROPLET) | 3 |
| 3 | L (LARGE DROPLET) | 10 |

Fig. 9

| JETTING TIMING | tm1 | tm2 | ... | tm(n−2) | tm(n−1) | tm(n) | tm(n+1) | tm(n+2) | ... |
|---|---|---|---|---|---|---|---|---|---|
| TYPE OF DROPLET | L | M | | NIL | S | M | L | L | |

Fig. 10

| SECOND JETTING MODE No. | TYPE OF LIQUID DROPLETS | VOLUME OF LIQUID DROPLETS (pl) |
|---|---|---|
| 0 | NIL | 0 |
| 1 | S1 (SMALL DROPLET 1) | 1 |
| 2 | S2 (SMALL DROPLET 2) | 1.5 |
| 3 | M1 (MEDIUM DROPLET 1) | 3 |
| 4 | M2 (MEDIUM DROPLET 2) | 5 |
| 5 | L1 (LARGE DROPLET 1) | 10 |
| 6 | L2 (LARGE DROPLET 2) | 16 |

Fig. 11A

| JETTING TIMING | tm(n-1) | tm(n) | tm(n+1) |
|---|---|---|---|
| TYPE OF LIQUID DROPLETS | NIL | S→S1 | NIL |
| | NIL | S→S1 | S |
| | NIL | S→S2 | M |
| | NIL | S→S2 | L |
| | S | S→S1 | NIL |
| | S | S→S1 | S |
| | S | S→S2 | M |
| | S | S→S2 | L |
| | M | S→S1 | NIL |
| | M | S→S1 | S |
| | M | S→S2 | M |
| | M | S→S2 | L |
| | L | S→M1 | NIL |
| | L | S→M1 | S |
| | L | S→M1 | M |
| | L | S→M1 | L |
| | NIL | M→M1 | NIL |
| | NIL | M→M1 | S |
| | NIL | M→M2 | M |
| | NIL | M→M2 | L |
| | S | M→M1 | NIL |
| | S | M→M1 | S |
| | S | M→M2 | M |
| | S | M→M2 | L |
| | M | M→M1 | NIL |
| | M | M→M1 | S |
| | M | M→M2 | M |
| | M | M→M2 | L |
| | L | M→M1 | NIL |
| | L | M→M1 | S |
| | L | M→M2 | M |
| | L | M→M2 | L |

Fig. 11B

| JETTING TIMING | tm(n−1) | tm(n) | tm(n+1) |
|---|---|---|---|
| TYPE OF LIQUID DROPLETS | NIL | L→L1 | NIL |
| | NIL | L→L1 | S |
| | NIL | L→L2 | M |
| | NIL | L→L2 | L |
| | S | L→L1 | NIL |
| | S | L→L1 | S |
| | S | L→L2 | M |
| | S | L→L2 | L |
| | M | L→L1 | NIL |
| | M | L→L1 | S |
| | M | L→L2 | M |
| | M | L→L2 | L |
| | L | L→L1 | NIL |
| | L | L→L1 | S |
| | L | L→L2 | M |
| | L | L→L2 | L |

Fig. 12

| JETTING TIMING | tm(n-1) | tm(n) | tm(n+1) |
|---|---|---|---|
| TYPE OF LIQUID DROPLETS | NIL | S→S2 | YES |
| | NIL | S→S1 | NIL |
| | S | S→S2 | YES |
| | S | S→S1 | NIL |
| | M | S→S2 | YES |
| | M | S→S1 | NIL |
| | L | S→M1 | YES |
| | L | S→M1 | NIL |
| | NIL | M→M2 | YES |
| | NIL | M→M1 | NIL |
| | S | M→M2 | YES |
| | S | M→M1 | NIL |
| | M | M→M2 | YES |
| | M | M→M1 | NIL |
| | L | M→M2 | YES |
| | L | M→M1 | NIL |
| | NIL | L→L2 | YES |
| | NIL | L→L1 | NIL |
| | S | L→L2 | YES |
| | S | L→L1 | NIL |
| | M | L→L2 | YES |
| | M | L→L1 | NIL |
| | L | L→L2 | YES |
| | L | L→L1 | NIL |

Fig. 13

| SECOND JETTING MODE No. | VALUE (j=7) | TYPE OF LIQUID DROPLETS | VOLUME OF LIQUID DROPLETS (pl) |
|---|---|---|---|
| 0 | 0 | NIL | 0 |
| 1 | 0.5 | S1 (SMALL DROPLET 1) | 1.0 |
| 2 | 1.0 | S2 (SMALL DROPLET 2) | 1.5 |
| 3 | 1.5 | M1 (MEDIUM DROPLET 1) | 3.0 |
| 4 | 2.0 | M2 (MEDIUM DROPLET 2) | 5.0 |
| 5 | 2.5 | L1 (LARGE DROPLET 1) | 10.0 |
| 6 | 3.0 | L2 (LARGE DROPLET 2) | 16.0 |

Fig. 14

| i(n) | j(n) |
|---|---|
| 0 | 0 |
| | 0.5 |
| 1 | 1.0 |
| | 1.5 |
| 2 | 2.0 |
| | 2.5 |
| 3 | 3.0 |

Fig. 15

| SECOND JETTING MODE No. | VALUE (j=8) | TYPE OF LIQUID DROPLETS | VOLUME OF LIQUID DROPLETS (pl) |
|---|---|---|---|
| 0 | 0 | NIL | 0 |
| 1 | 1 | S1 (SMALL DROPLET 1) | 1.0 |
| 2 | 2 | S2 (SMALL DROPLET 2) | 1.5 |
| 3 | 3 | M1 (MEDIUM DROPLET 1) | 2.0 |
| 4 | 4 | M2 (MEDIUM DROPLET 2) | 3.0 |
| 5 | 5 | M3 (MEDIUM DROPLET 3) | 5.0 |
| 6 | 6 | L1 (LARGE DROPLET 1) | 10.0 |
| 7 | 7 | L2 (LARGE DROPLET 2) | 16.0 |

Fig. 16

| i(n) | j(n) |
|---|---|
| 0 | 0 |
| | 1 |
| 1 | 2 |
| | 3 |
| 2 | 4 |
| | 5 |
| 3 | 6 |
| | 7 |

LIQUID DROPLET JETTING APPARATUS AND PROGRAM FOR CONTROLLING JETTING A LIQUID DROPLET

CROSS REFERENCE TO RELATED APPLICATION

The present application claims priority from Japanese Patent Application No. 2008-116618, filed on Apr. 28, 2008 the disclosures of which are incorporated herein by reference in its entirety.

BACKGROUND OF THE INVENTION

1. Field of the Invention

The present invention relates to a liquid droplet jetting apparatus and a program for controlling jetting a liquid droplet.

2. Description of the Related Art

As a liquid droplet jetting apparatus which jets liquid droplets from nozzles, an ink-jet printer which records a desired image by jetting droplets of an ink onto a recording medium has hitherto been known. Generally, such ink-jet printer is capable of representing gradation (gradation printing). That is, the ink-jet printer selectively jets a plurality of types of liquid droplets having different size (volume) from nozzles each forming a dot, based on gradation information of each pixel which forms an image.

Japanese Patent Application Laid-open No. 2005-205685 discloses an ink-jet multifunction device including a scanner section which scans an image on a paper document and a printer section which prints an image on a recording paper. Moreover, this multifunction device includes an Application Specific Integrated Circuit (ASIC) which controls driving of sections such as the scanner section and the printer section, and which retrieve data from each section of the multifunction device to process at a high speed.

The ASIC includes an image processing circuit which converts image data transmitted from an external information processing apparatus or the scanner section to data that is necessary for the printer to record an image on a recording paper. Particularly, the image processing circuit determines a diameter of a dot (a size of a liquid droplet) among three sizes, namely, large, small, and zero, based on a gradation information of each pixel that is acquired from image data transmitted from the scanner section. Moreover, the image processing circuit transmits information related to the diameter of each dot to a recording head of the printer section, and based on that information, the recording head jets the liquid droplets from the nozzles.

SUMMARY OF THE INVENTION

Incidentally, more the types of droplets which are jettable from one nozzle, more gradations can be represented, thereby enabling an image printing of a high image quality. However, as the number of types of the liquid droplets is increased, a high performance (high efficiency) of the ASIC or memory is sought, and a cost for hardware becomes high.

For instance, in the Japanese Patent Application Laid-open No. 2005-205685, the size of the dot (types of liquid droplets) is of three types (three gradations) namely, large, small, and zero. Therefore, data of two bit is enough for showing a selection of the types of liquid droplets to be jetted from the nozzle for forming the dot. However, when the types of liquid droplets are increased to five to represent five gradations, data of 3 bit is necessary. When the data, about each of the large number of dots forming an image, associated to the types of liquid droplets increases from 2 bits to 3 bits, it is necessary to carry out each of various data processing by the ASIC thereafter by 3 bit. Therefore, a configuration of the ASIC becomes complicated, and a large temporary storage area for the increased data has to be prepared.

An object of the present invention to provide a liquid droplet jetting apparatus which is capable of jetting selectively liquid droplets of large number of types from each of the nozzles, while keeping an electrical structure of the apparatus as simple as possible, and to provide a program for controlling jetting liquid droplets.

According to a first aspect of the present invention, there is provided a liquid droplet jetting apparatus which jets a droplet of a liquid from a nozzle in a plurality of jetting modes, selectively, which are different from each other in a volume of the droplet, the apparatus including:

a first jetting mode memory which stores information about a plurality of first jetting modes;

a time-sequence information memory which stores time-sequence information of the first jetting modes, which is associated, for each of jetting timings of the nozzle, with one of the first jetting modes stored in the first jetting mode memory;

a second jetting mode memory which stores information about a plurality of second jetting modes of which number is more than that of the plurality of first jetting modes; and a jetting mode selector which selects, at a certain jetting timing, a second jetting mode among the plurality of second jetting modes stored in the second jetting mode memory, based on one first jetting mode associated with the certain jetting timing and another first jetting mode associated with a successive jetting timing which is at least one of previous and subsequent jetting timings of the certain jetting timing, included in the time-sequence information stored in the time-sequence information memory.

In the present invention, one of the plurality of first jetting modes each of which corresponds to a distinct volume of the liquid droplet is associated with each of the jetting timings of the nozzle by the time-sequence information stored in the time-sequence information memory, Whereas, in the second jetting mode memory, information about the plurality of second jetting modes of which types are more than types of the plurality of first jetting modes is stored. Moreover, the jetting mode selector selects the second jetting mode at the arbitrary jetting timing, among the plurality of second jetting modes, by referring to the one first jetting mode associated with the arbitrary jetting timing and the another first jetting mode associated with the successive jetting timing which is at least one of the previous and subsequent jetting timings.

In other words, the jetting mode selector selects the second jetting mode at the arbitrary jetting timing, among the plurality of second jetting modes which are more than the first jetting modes, by referring to the one first jetting mode (jetting history information) at the arbitrary jetting timing and the another first jetting mode at the successive jetting timing included in the time-sequence information. Accordingly, it is possible to increase the number of types of liquid droplets jetted practically from one nozzle (types of the second jetting modes), while suppressing an amount of data of the time-sequence information from increasing, because the types of the first jetting modes associated with each jetting timing in the time-sequence information can be decreased. Consequently, it is possible to suppress a circuit which processes the time-sequence information from becoming complicated, and to suppress an increase in a storage area which is necessary for storing processing data, and it is possible to make jet the liquid droplets of a large number of types from one nozzle while simplifying a structure of the hardware.

According to the present invention, the time-sequence information memory may store the time-sequence information which is transmitted from an external apparatus which is communicably connected to the liquid droplet jetting apparatus. When an amount of data of the time-sequence information is large, a time for transmission of data from the external apparatus becomes long. However, in the present invention, since the types of the first jetting mode associated with each jetting timing by the time-sequence information are smaller than the second jetting modes which are the final jetting modes, it is possible to decrease the amount of data of the time-sequence information, and to shorten a data-transmission time. The jetting mode selector may select the second jetting mode at the arbitrary jetting timing among the plurality of second jetting modes by referring to both of the first jetting mode associated with the previous jetting timing, and the another first jetting mode associated with the subsequent jetting timing. In this case, it is possible to select even more favorable second jetting mode among the plurality of second jetting modes, and to carry out a high quality printing in which a gradation is controlled in even more favorable manner.

According to the present invention, the jetting mode selector may select, at an arbitrary jetting timing, the second jetting mode among the plurality of second jetting modes such that a difference in the volume of the droplet between the second jetting mode at the certain jetting timing and the first jetting mode at the successive jetting timing is smaller than that between the first jetting mode at the certain jetting timing and the first jetting mode at the successive jetting timing. In this case, it is possible to to reduce a temporal change in the volume of the liquid droplets jetted continuously from one nozzle.

According to a second aspect of the present invention, there is provided a liquid droplet jetting apparatus which jets droplets of a liquid, from a nozzle, of volumes different from each other according to input signals corresponding to the volumes of the droplets, the apparatus including:

a jetting head in which the nozzle is formed;

a converter which converts a multi-valued input signal i(n) of multi-value I to a multi-valued signal j(n) of multi-value J (J>I); and a driver which drives the head to jet the droplets of the volumes according to a multi-value of the multi-valued signal j(n) converted by the converter, wherein the converter converts the multi-valued input signal i(n), which is input sequentially to the converter and which is expressed by . . . i(n−1), i(n), i(n+1) . . . , to j(n) such that a difference between j(n) and at least one of i(n−1) and i(n+1) is smaller than a difference between i(n) and the at least one of i(n−1) and i(n+1).

The liquid droplet jetting apparatus according to the second aspect of the present invention includes the converter which converts the multi-valued input signal i(n) of multi-value I to the multi-valued signal j(n) of multi-value J which is larger than the multi-value I. Therefore, similar as the liquid droplet jetting apparatus according to the first aspect of the present invention, the liquid droplet jetting apparatus according to the second aspect of the present invention is capable of increasing the number of types of liquid droplets jetted practically from one nozzle, while suppressing the amount of data of the time-sequence information from increasing by decreasing the number of types of the first jetting mode associated with each jetting timing by the time-sequence information. Accordingly, it is possible to carry out the gradation even more smoothly with a simple structure. It is possible to find directly the second jetting mode at an arbitrary timing by a predetermined calculation even without referring to the jetting mode information stored in the first jetting mode memory and the second jetting mode memory, as in the liquid droplet jetting apparatus according to the first aspect. The converter may be a central processing unit (CPU) or a computer which carries out logical operations.

According to a third aspect of the present invention, there is provided a program for controlling jetting a liquid droplet which causes the droplet to be jetted from a nozzle in a plurality of jetting modes, selectively, which are different from each other in a volume of the droplet, the program making a computer operate as:

a first jetting mode memory which stores information about a plurality of first jetting modes;

a time sequence information memory which stores time-sequence information of the first jetting modes which is associated with, for each of jetting timings of the nozzle, one of the first jetting modes stored in the first jetting mode memory;

a second jetting mode memory which stores information about a plurality of second jetting modes of which number is more than that of the plurality of first jetting modes; and a jetting mode selector which selects, at a certain jetting timing, a second jetting mode among the plurality of second jetting modes stored in the second jetting mode memory, based on one first jetting mode associated with the certain jetting timing and another first jetting mode associated with successive jetting timing which is at least one of previous and subsequent jetting timings of the certain jetting timing, included in the time-sequence information stored in the time-sequence information memory.

According to the liquid droplet jetting control program, the jetting mode selector selects the second jetting mode at the arbitrary jetting timing, among the plurality of second jetting modes which are more than the first jetting modes, by referring to the first jetting mode (jetting history information) at the arbitrary jetting timing and the first jetting mode at the previous jetting timing and the subsequent jetting timing included in the time-sequence information. Accordingly, it is possible to increase the number of types of liquid droplets jetted practically from one nozzle (types of the second jetting modes), while suppressing an amount of data of the time-sequence information from increasing, by decreasing the types of the first jetting modes associated with each jetting timing by the time-sequence information. Consequently, it is possible to make jet the liquid droplets of a large number of types from one nozzle while suppressing an increase in a storage area which is necessary for storing the processing data, and an improved performance of the CPU which executes the program.

According to the first to third aspects of the present invention, it is possible to suppress a circuit which processes the time-sequence information from becoming complicated, and to suppress an increase in a storage area which is necessary for storing processing data, and it is possible to make jet the liquid droplets of a large number of types from one nozzle while simplifying a structure of the hardware.

BRIEF DESCRIPTION OF THE DRAWINGS

FIG. 8 is a diagram showing an association of four first jetting modes and types of liquid droplets;

FIG. 9 is a diagram showing a time-sequence information for a certain nozzle;

FIG. 10 is a diagram showing an association of seven second jetting modes and liquid droplet types;

FIGS. 11A and 11B are diagrams showing a table of a jetting-mode selection process;

FIG. 12 is a diagram showing a table of a jetting-mode selection process according to a modified embodiment;

FIG. 13 is a diagram showing an association of a seven second jetting modes and liquid droplet types according to a second embodiment;

FIG. 14 is a diagram showing a relationship between i values corresponding to four first jetting modes, and j values corresponding to seven second jetting modes according to the second embodiment;

FIG. 15 is a diagram showing a table of a jetting mode selection process according to another example of the second embodiment; and FIG. 16 is a diagram showing a relationship between i values corresponding to four first jetting modes and j values corresponding to eight second jetting modes according to the second embodiment.

DETAILED DESCRIPTION OF THE PREFERRED EMBODIMENTS

First Embodiment

A first embodiment of the present invention will be described below. The first embodiment is an example in which the present invention is applied to an ink-jet printer including an ink-jet head which jets droplets of ink onto a recording paper.

Figure 1:
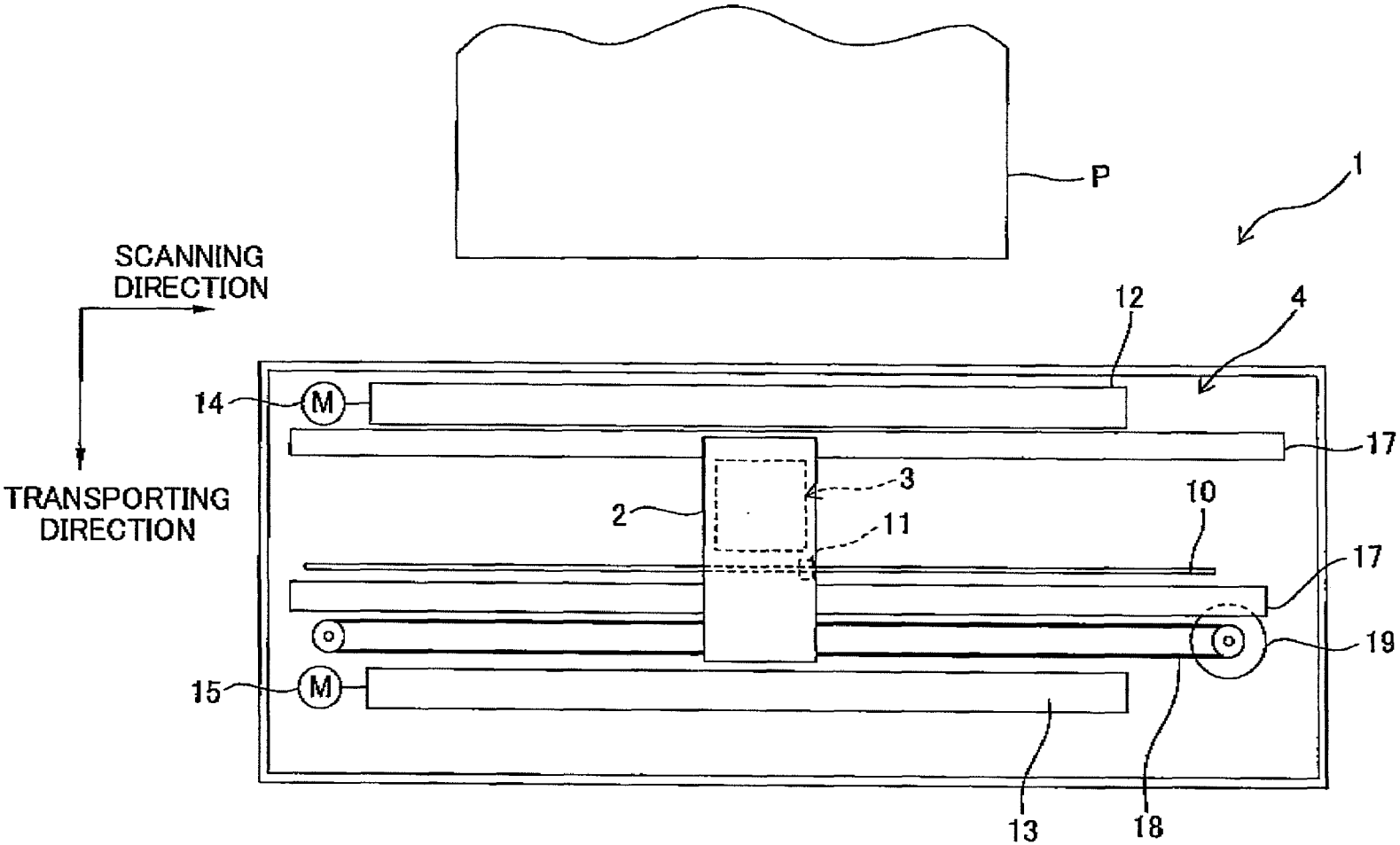
FIG. 1 is a schematic plan view of a printer according to a first embodiment of the present invention.

Firstly, a schematic structure of an ink-jet printer 1 according to the first embodiment will be described below. FIG. 1 is a schematic plan view of the ink-jet printer 1 of according to the first embodiment. As shown in FIG. 1, the ink-jet printer 1 includes a carriage 2 which is reciprocatable in a predetermined scanning direction (left-right direction in FIG. 1), an ink-jet head 3 which is mounted on the carriage 2, and a transporting mechanism 4 which transports the recording paper P in a transporting direction which is orthogonal to the scanning direction.

The carriage 2 is reciprocatable along two guide shafts 17 extended parallel to the scanning direction (left-right direction in FIG. 1). Moreover, an endless belt 18 is coupled with the carriage 2, and when the endless belt 18 is driven to turn by a carriage driving motor 19, the carriage 2 moves in the scanning direction together with the turning of the endless belt 18. The ink-jet printer 1 is provided with a linear encoder 10 which has a plurality of light transmission portions (slits) arranged in a row at an interval in the scanning direction. On the other hand, the carriage 2 is provided with a photo sensor 11 of a light transmitting type having a light emitting element and a light receiving element. Moreover, the ink-jet printer 1 is capable of identifying a current position of the carriage 2 in the scanning direction, based on the counts (detection counts), of the light transmission portion of the linear encoder 10, detected by the photo sensor 11 during the movement of the carriage 2.

The ink-jet head 3 is mounted on the carriage 2. A plurality of nozzles 30 is formed in a lower surface of the ink-jet head 3 (refer to FIG. 3). The ink-jet head 3 jets an ink, supplied from an ink cartridge which is not shown in the diagram, via the plurality of nozzles 30 onto the recording paper P which is transported downward (direction of transporting) in FIG. 1 by the transporting mechanism 4.

The transporting mechanism 4 has a paper feeding roller 13 which is arranged at an upstream side in the transporting direction than the ink-jet head 3, and a paper discharge roller 13 which is arranged at a downstream side in the transporting direction than the ink-jet head 3. The paper feeding roller 12 and the paper discharge roller 13 are driven by a paper feeding motor 14 and the paper discharge motor 15, respectively. Moreover, the transporting mechanism 4 transports the recording paper P from an upper side in FIG. 1 toward a position facing the ink-jet head 3 by the paper feeding roller 12, and discharges the recording paper P, on which an image or characters are recorded by the ink-jet head 3, toward a lower side in FIG. 1 by the discharge roller 13.

Figure 2:
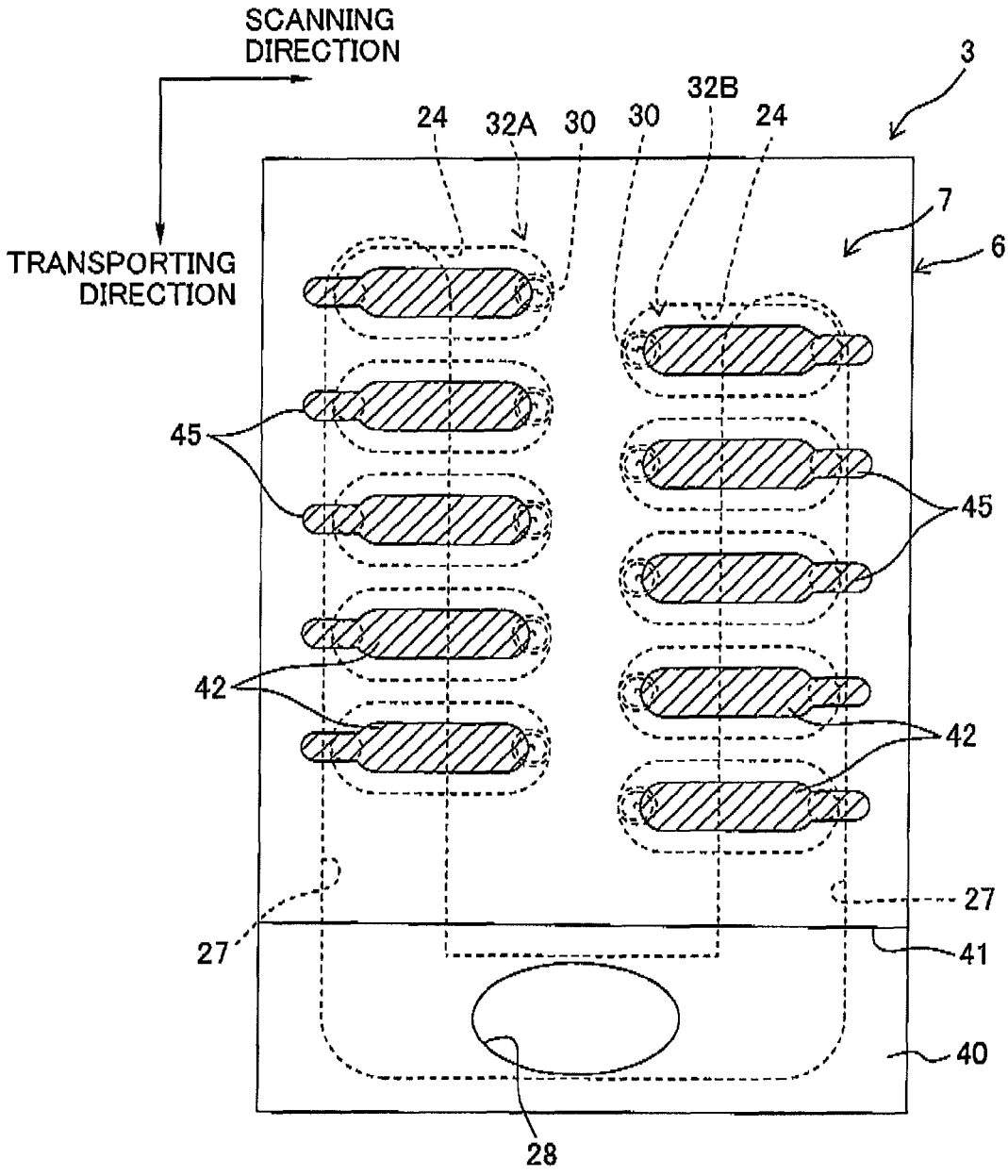
FIG. 2 is a plan view of an ink-jet head.
Figure 3:
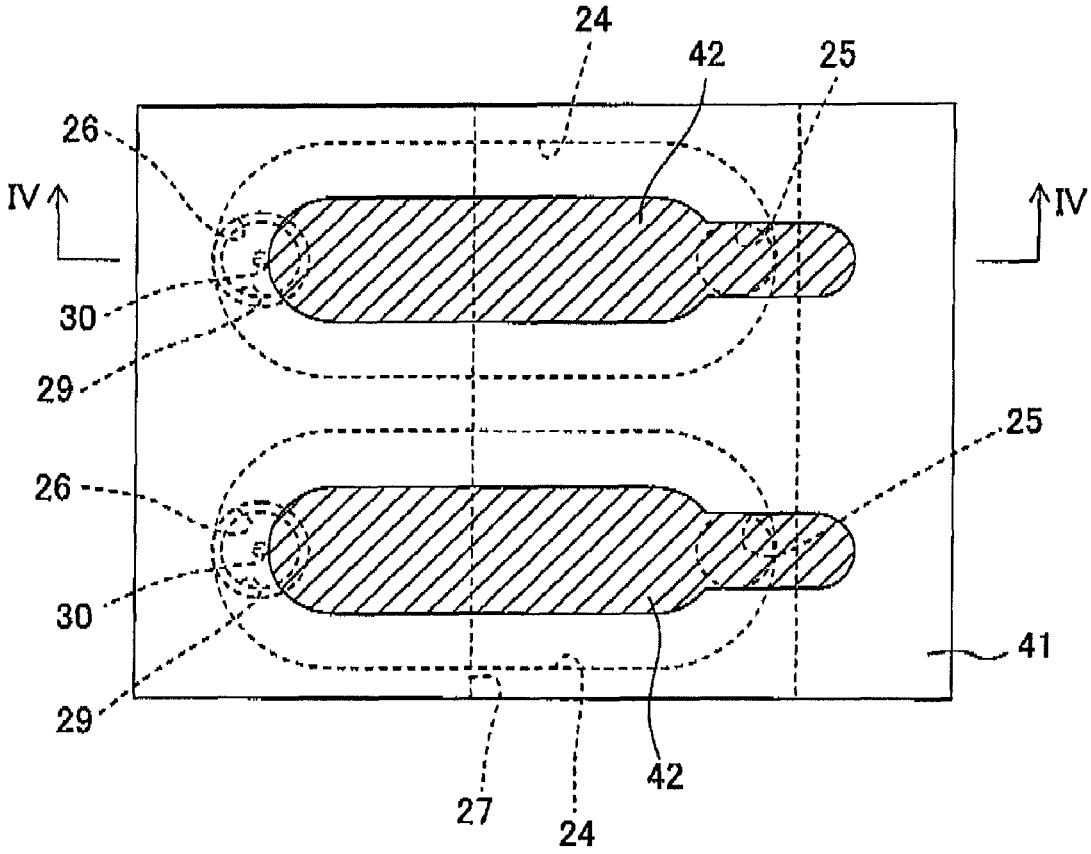
FIG. 3 is a partially enlarged view of FIG. 2.
Figure 4:
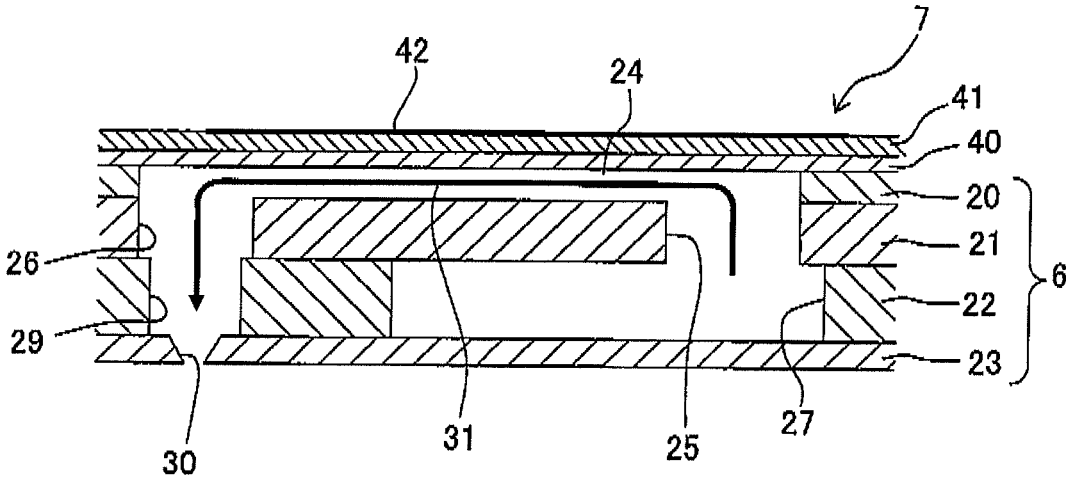
FIG. 4 is a cross-sectional view taken along a line IV-IV in FIG. 3.

Next, the ink-jet head 3 will be described below. FIG. 2 is a plan view of the ink-jet head 3, FIG. 3 is a partially enlarged view of FIG. 3, and FIG. 4 is a cross-sectional view taken along a IV-IV line in FIG. 3. As shown in FIGS. 2, 3, and 4, the ink-jet head 3 includes a channel unit 6 in which ink channels including the nozzles 30 and pressure chambers 24 are formed, and an actuator unit 7 of a piezoelectric type which applies a pressure to the ink in the pressure chamber 24.

Firstly, the channel unit 6 will be described below. As shown in FIG. 4, the channel unit 6 includes a cavity plate 20, a base plate 21, a manifold plate 22, and a nozzle plate 23. These four plates 20 to 23 are joined in a stacked form. The cavity plate 20, the base plate 21, and the manifold plate 22 have a substantially rectangular shape in a plan view, and these plates 20 to 22 are made of a metallic material such as stainless steel. Therefore, it is possible to form the ink channels such as the pressure chamber 24 and the manifold 27 which will be described later easily in these three plates 20 to 22 by an etching. Moreover, the nozzle plate 23 is formed of a high-molecular synthetic resin material such as polyimide, and is joined to a lower surface of the manifold plate 22. Alternatively, the nozzle plate 23 may also be formed of a metallic material such as stainless steel similarly as the other three plates 20 to 22.

As shown in FIGS. 2 to 4, the plurality of pressure chambers 24 are formed as through holes cut through the cavity plate 20 which is positioned at an uppermost side of the four plates 20 to 23 (positioned at the top). Moreover, the pressure chambers 24 are arranged in two rows in a zigzag form in the transporting direction (vertical direction in FIG. 2). Moreover, as shown in FIG. 4, both side (upper side and lower side) of the pressure chambers 24 are covered by the base plate 21 and the vibration plate 40 which will be described later. Furthermore, each of the pressure chambers 24 is formed to be substantially elliptical-shaped which is elongated in the scanning direction (left-right direction in FIG. 2) in a plan view.

As shown in FIGS. 3 and 4, communicating holes 25 and 26 are formed in the base plate 21, at positions overlapping with both end portions in the longitudinal direction of the pressure chamber 24 in a plan view. Moreover, two manifolds 27 extended in the transporting direction are formed in the manifold plate 22, to overlap with a portion, of the pressure chambers 24, toward the communicating hole 25 arranged in two rows in a plan view. These two manifolds 27 communicate with an ink supply port 28 formed in the vibration plate 40 which will be described later, and the ink is supplied from an ink tank which is not shown in the diagram to the manifold 27 via the ink supply port 28. Furthermore, a plurality of communicating holes 29 which communicate with the plurality of communicating holes 26 are also formed in the manifold plate 22, at positions overlapping with an end portions, of the pressure chambers 24, located at an opposite side of the manifold 27 in a plan view.

Furthermore, the plurality of nozzles 30 are formed in the nozzle plate 23, at positions overlapping with the plurality of communicating holes 29 in a plan view. As shown in FIG. 2, the plurality of nozzles 30 is arranged to overlap with end portions of the plurality of pressure chambers 24 arranged in two rows along the transporting direction, at the opposite side of the manifold 27. In other words, the plurality of nozzles 30 are arranged in zigzag form to form two nozzle rows 32A and 32B lined up in the scanning direction, corresponding to the plurality of pressure chambers 24 arranged in the zigzag form.

Moreover, as shown in FIG. 4, the manifold 27 communicates with the pressure chambers via the communicating holes 25, and furthermore, the pressure chambers 24 communicate with the nozzles 30 via the communicating holes 26 and 29. In this manner, a plurality of individual ink channels 31 from the manifold 27 up to the nozzles 30 via the pressure chambers 24 are formed in the channel unit 6.

In FIG. 2, for simplifying the explanation, one type of the channel structure (the manifold 27, the pressure chambers 24, and the nozzles 30) communicating with one ink supply port 28 is drawn. However, the ink-jet head 3 may be a color ink-jet head having a structure provided with a plurality of channel structures shown in FIG. 2 lined up in the scanning direction, which is capable of jetting inks of a plurality of colors (such as four colors namely, black, yellow, cyan, and magenta).

Next, the actuator unit 7 will be described below. As shown in FIGS. 2 to 4, the actuator unit 7 includes the vibration plate 40 which is arranged on an upper surface of the channel unit 6 (the cavity plate 20) to cover the plurality of pressure chambers 24, a piezoelectric layer 41 which is arranged on an upper surface of the vibration plate 40 to face the plurality of pressure chambers 24, and a plurality of individual electrodes 42 which are arranged on an upper surface of the piezoelectric layer 41.

The vibration plate 40 is made of an iron alloy such as stainless steel, a copper alloy, a nickel alloy, and a titanium alloy. The vibration plate 40 is joined to the cavity plate 20 such that the vibration plate 40 is arranged on the upper surface of the cavity plate 20 to cover the plurality of pressure chambers 24. Moreover, an upper surface of the vibration plate 40 which is electroconductive also serves as a common electrode which generates an electric field, in a thickness direction of the piezoelectric layer 41, between the common electrode and the plurality of individual electrodes 42 located on the upper surface of the piezoelectric layer 41, when the vibration plate 40 is arranged on a lower surface side of the piezoelectric layer 41. The vibration plate 40 as a common electrode is connected to a ground wire of a driver IC 47 (refer to FIG. 6) which drives the actuator unit 7, and is kept at a ground electric potential all the time.

The piezoelectric layer 41 is made of a piezoelectric material which is principally composed of lead zirconate titanate (PZT) which is a solid solution of lead titanate and lead zirconate, and which is a ferroelectric material. As shown in FIG. 2, the piezoelectric layer 41 is formed on the upper surface of the vibration plate 40 to be continuously spread over the plurality of pressure chambers 24. Moreover, the piezoelectric layer 41 is polarized in a thickness direction thereof, at least in an area facing the pressure chamber 24.

The plurality of individual electrodes 42 is formed on the upper surface of the piezoelectric layer 41, in an area facing the plurality of pressure chambers 24. Each of the individual electrodes 42 has a substantially elliptical shape, in a plan view, slightly smaller than the pressure chambers 24, and is facing a central portion of one of the pressure chambers 24. Moreover, from end portions of the plurality of individual electrodes 42, a plurality of contact points 45 are drawn in a longitudinal direction of the individual electrodes 42 respectively. The contact points 45 are electrically connected to the driver IC 47 (refer to FIG. 6) via a flexible printed circuit (FPC) which is not shown in the diagram. Accordingly, it is possible to apply selectively one of a predetermined driving electric potential and a ground electric potential to the individual electrodes 42 from the driver IC 47.

Next, an action of the piezoelectric unit 7 at the time of ink jetting will be described below. When the predetermined driving electric potential is applied by the driver IC 47 to a certain individual electrode 42, an electric potential difference is generated between the individual electrode 42 to which the driving electric potential is applied and the vibration plate 40 as the common electrode which is kept at the ground electric potential, and an electric field in the thickness direction is generated in the piezoelectric layer 41 sandwiched between the individual electrode 42 and the vibration plate 40. Since the direction of the electric field is parallel to a polarization direction of the piezoelectric layer 41, an area (active area) of the piezoelectric layer 41 facing the individual electrode 42 contracts in an in-plane direction which is orthogonal to the thickness direction. Here, since the vibration plate 40 located at the lower side of the piezoelectric layer 41 is fixed to the cavity plate 20, when the piezoelectric layer 41 positioned on the upper surface of the vibration plate 40 is contracted in the in-plane direction, a portion of the vibration plate 40 covering the pressure chamber 24 is deformed to form a projection toward the pressure chamber 24 (unimorph deformation). At this time, since a volume inside the pressure chamber 24 decreases, an ink pressure (a pressure on the ink) inside the pressure chamber rises up, and the ink is jetted from the nozzle which communicates with this pressure chamber 24.

Here, for carrying out a high quality image printing by a multi-gradation printing, the ink-jet head 3 in the first embodiment performs printing in a plurality of jetting modes, in each of which different volume of liquid droplets are jetted from each of the nozzles 30, that is, the ink-jet head 3 is configured to make it possible to jet with a plurality of jetting conditions with different volume of the liquid droplets jetted.

Concretely, the driver IC 47 supplies a drive signal to the actuator unit 7, based on data related to types of liquid droplets associated with each jetting timing of one nozzle, which is generated by a data generating circuit 60 (refer to FIG. 6) of an ASIC 54 which will be described later. Here, an amount of liquid droplets (volume of liquid droplets) jetted from the nozzle 30 is proportional to a magnitude of a pressure applied to the ink in the pressure chamber 24. Therefore, when the driver IC 47 supplies a plurality of types of drive signal of different waveforms to the individual electrode 42 of the actuator unit 7 such that the pressure applied to the ink in the pressure chamber 24 is different, it is possible to make jet the liquid droplets of a plurality of types of different size from the nozzle 30.

Figure 5A:
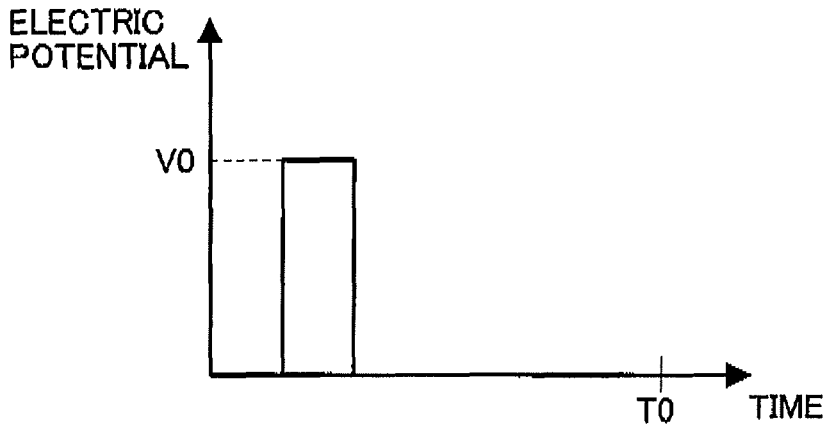
FIGS. 5A, 5B and 5C are pulse-waveform diagrams of drive signals.
Figure 5B:
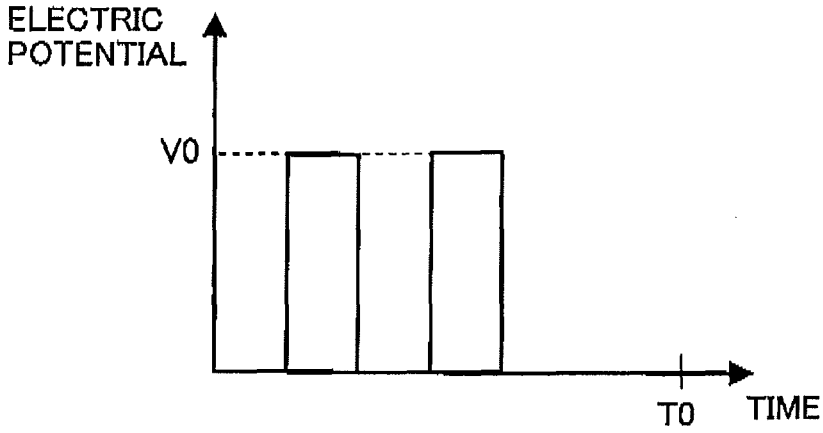
Figure 5C:
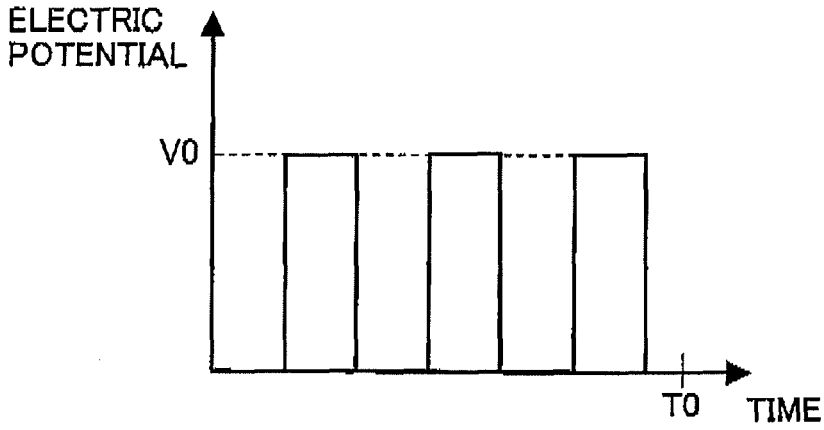

For example, as shown in FIGS. 5A, 5B, and 5C, driver IC 47 supplies a driving electric potential V0 to the individual electrode 42 at a variety of frequencies (number of drive pulses) during a predetermined time period (cycle) T0 of jetting one droplet. When a plurality of drive pulses are applied continuously at an appropriate timing, pressure waves generated inside the pressure chamber 24 due to the drive pulses overlap with each other. Therefore, when large number of drive pulses are applied, it is possible to apply a substantial pressure inside the pressure chamber 24.

Or, a value of the driving electric potential V0 may be changed. Higher the value of the driving electric potential V0, greater (higher) is an electric potential difference between the individual electrode 42 and the vibration plate 40 as a common electrode which is kept at the ground electric potential. Therefore, the deformation (piezoelectric distortion) of the piezoelectric layer 41 becomes substantial, and it is possible to apply a substantial (high) pressure inside the pressure chamber 24.

Figure 6:
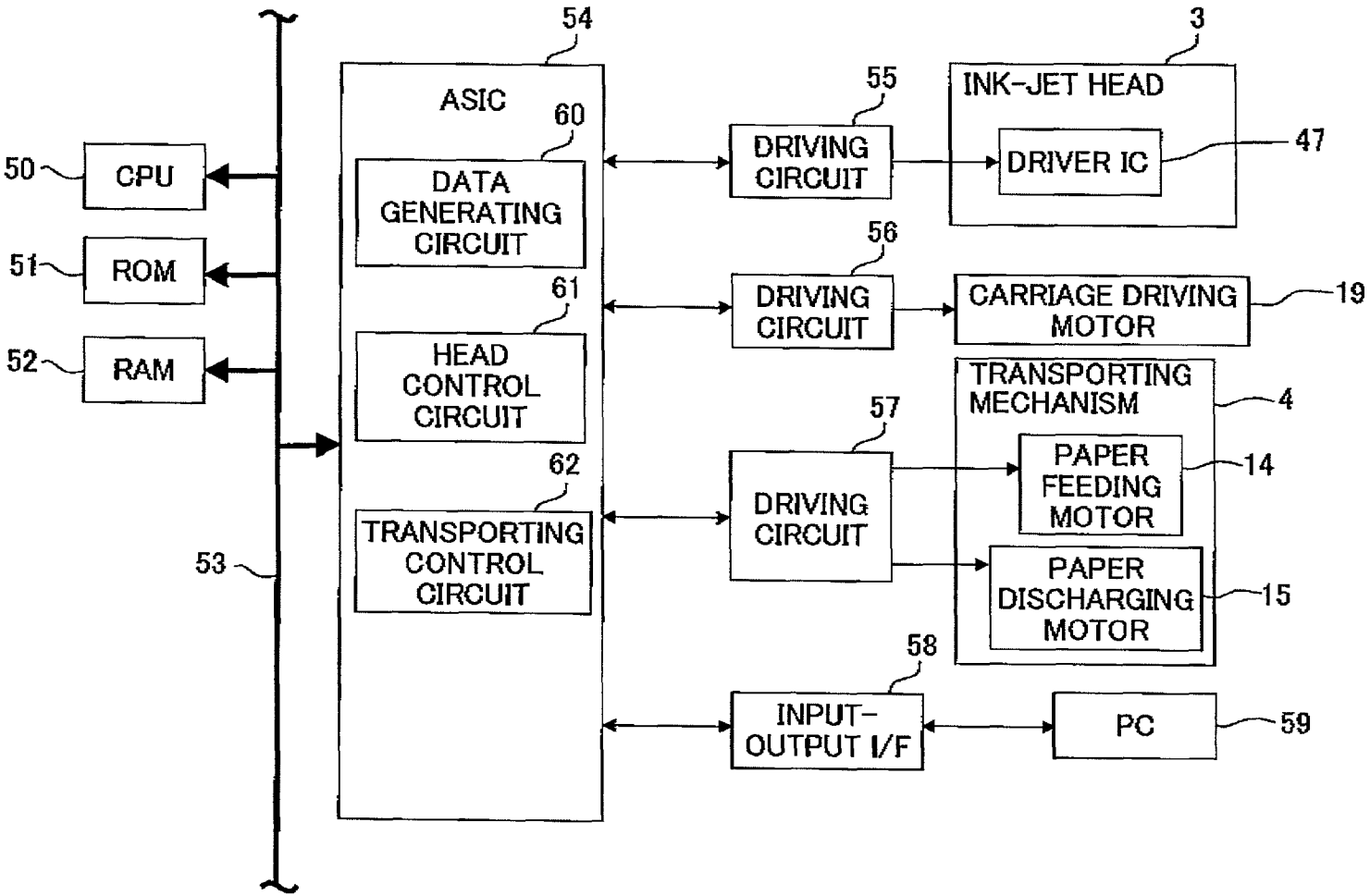
FIG. 6 is a block diagram of a control system of the printer.

Next, a control system of the ink-jet printer 1 will be described below with reference to a block diagram in FIG. 6. As shown in FIG. 6, the control system of the ink-jet printer 1 according to the first embodiment includes a microcomputer having a central processing unit (CPU) 50, a read only memory (ROM) 51, a random access memory (RAM) 52, and a bus 53 which connects these components. Moreover, the Application Specific Integrated Circuit (ASIC) 54 is connected to the bus 53 via driving circuits 55, 56, and 57, and ASIC 54 controls driving of the paper feeding motor 14 and the paper discharge motor 15 of the transporting mechanism 4, the carriage driving motor 19 which drives the carriage 2, and the driver IC 47 of the ink-jet head, via driving circuits 55, 56, 57, respectively. The ASIC 54 is data-communicably connected to a PC (personal computer) 59 which is an external apparatus, via an input-output interface (I/F) 58.

A data generating circuit 60, a head control circuit 61, and a transporting control circuit 62 are built-in (incorporated) in the ASIC 54. The head control circuit 61 generates data necessary for recording an image on the recording paper P by the ink-jet head 3, from image data which is input from the PC 59. The head control circuit 61 controls the carriage driving motor 19 and the driver IC 47 of the ink-jet head 3 based on the data generated by the data generating circuit 60. The transporting control circuit 62 controls the paper feeding motor 14 and the paper discharge motor 15 of the transporting mechanism 4 based on the data generated by the data generating circuit 60.

Next, the data generating circuit 60 will be described below in detail. In the first embodiment, in the PC 59, an image processing is carried out of image data of a predetermined recording image, and according to gradation information of each pixel which forms that recording image, a type of liquid droplets to be jetted from the nozzle 30 for forming a dot is determined from amount four types (small droplets, medium droplets, large droplets, and no liquid droplet jetting)

As for one nozzle 30, information for determining a jetting mode among the four (four gradation) jetting modes (first jetting modes), in which four types of liquid droplets of different volumes are jetted from the one nozzle 30 at a jetting timing of forming each dot, is generated by the PC 9. In other words, information which associates four jetting modes to each jetting timing of one nozzle 30 (time-sequence information of the jetting mode) is generated by the PC 9. Further, since a data of 2 bit serves the purpose of distinguishing the four first jetting modes, practically, time-sequence information including the data of 2 bit corresponding to each jetting timing is transmitted from the PC 59 to the data generating circuit 60 of the ASIC 54.

On the other hand, the data generating section 60 selects the jetting mode of each jetting timing among the seven jetting modes (7 steps of gradation) (second jetting modes), in which the types of liquid droplets are subdivided further than the four first jetting modes, based on the time-sequence information transmitted from the PC 59. In other words, the data generating circuit 60, generates data of 3 bit corresponding to the 7 steps of gradation (seven gradation) for each jetting timing, based on the time-sequence information which includes the data of 2 bit corresponding to four steps of gradation (four gradation) transmitted from the PC 59.

Figure 7:
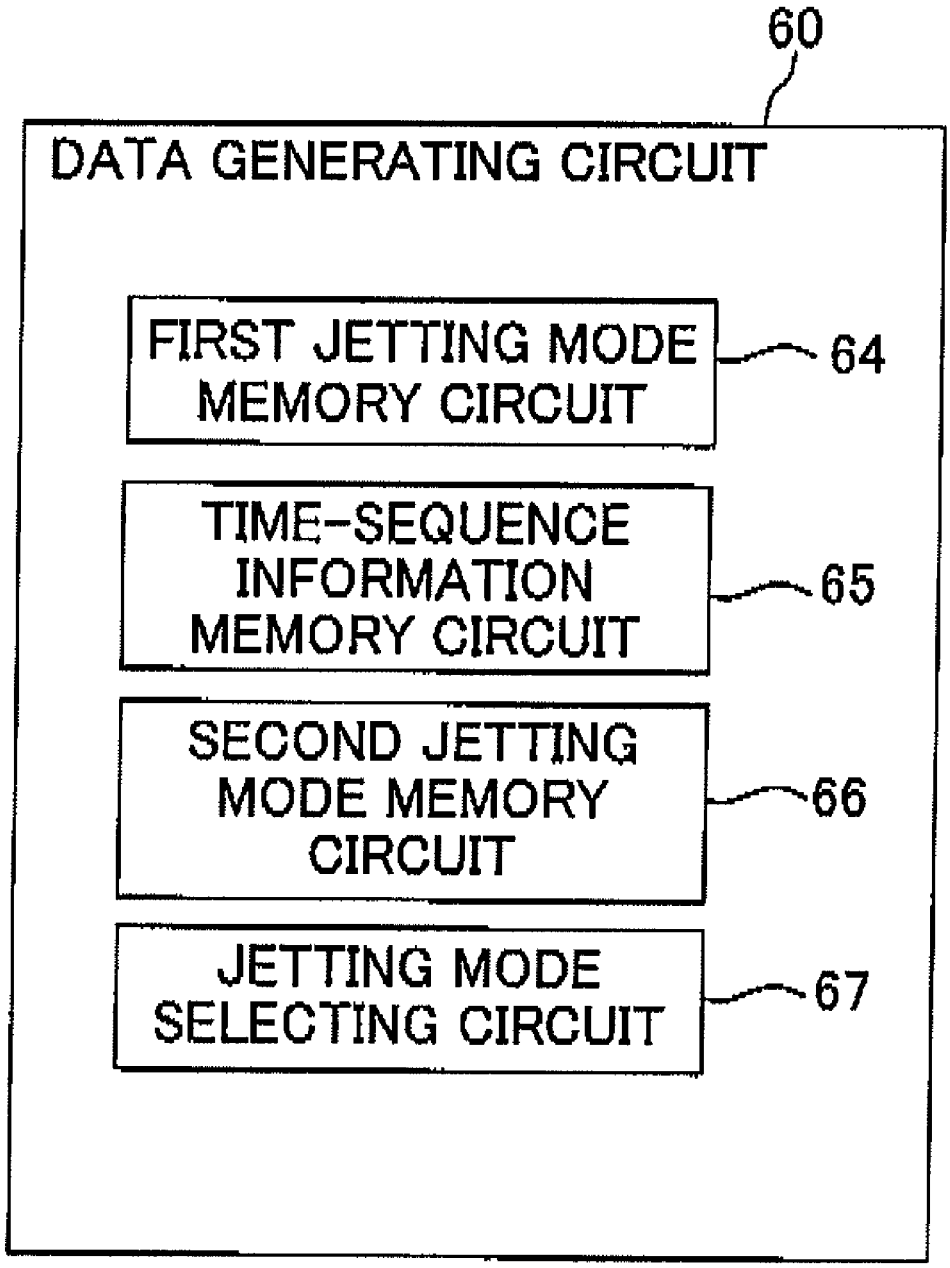
FIG. 7 is a block diagram of a data generating circuit.

FIG. 7 is a block diagram of the data generating circuit 60. The data generating circuit 60 includes a first jetting mode memory circuit 64 (first jetting mode memory), a time-sequence information memory circuit 65 (time-sequence information memory), a second jetting mode memory circuit 66 (second jetting mode memory), and a jetting mode selecting circuit 67 (jetting mode selector), which will be described below.

The first jetting mode memory circuit (or memory) 64 stores information related to four first jetting modes which are set for one nozzle 30 in the PC 59. Here, the information related to the four first jetting modes is information for distinguishing a certain first jetting mode from the other first jetting modes. More concretely, the information related to the four first jetting modes is information which indicates that one of the four types of liquid droplets corresponds to (is associated with) one of the four first jetting modes. FIG. 8 is a diagram showing the association of the four first jetting modes (from No. 0 to No. 3) and the types of liquid droplets which are jetted, and this information is stored in the first jetting mode memory circuit 64. As shown in FIG. 8, the first jetting mode memory circuit 64 stores the four first jetting modes upon associating with the type of liquid droplets to be Jetted (Nil (no liquid droplet jetting: volume of liquid droplets 0), S (small droplet), M (medium droplet), and L (large droplet), respectively. Moreover, the volume of the liquid droplet (unit: pl) is set for each of the four types of liquid droplets.

The time-sequence information memory circuit (or memory) 65 stores time-sequence information of a jetting mode which is transmitted from the PC 59. In this time-sequence information, each of the jetting timings for all nozzles 30 is associated with one of the four first jetting modes. In other words, the time-sequence information includes data of 2 bit for associating the four types of liquid droplets (Nil (no liquid droplet jetting: volume of liquid droplet 0), S (small droplet), M (medium droplet), and L (large droplet) with each of the jetting timing. The jetting timing is a timing of a fixed cycle (constant cycle) which is determined based on a clock.

The ink-jet head 3 according to the first embodiment jets liquid droplets from the nozzles toward the recording paper P while moving in the scanning direction at a constant speed, and at this time, the jetting timing comes for each of a fixed time interval. Here, the jetting timing is a timing at which there is a possibility of that a liquid droplet is jetted from the nozzle 30, however whether or not the liquid droplets are jetted practically at each jetting timing depends on an image to be recorded. For instance, when the liquid droplets are daubed all over the recording paper P, that is, dots are formed on an entire surface of the recording paper P, the nozzle 30 jets the liquid droplets at all the jetting timings. On the other hand, when small numbers of dots are formed on the recording paper P (text printing), the liquid droplets are not always jetted at all the jetting timings.

FIG. 9 is a diagram showing time-sequence information of a jetting mode with respect to a certain nozzle 30. As shown in FIG. 9, in this time-sequence information, a plurality of jetting timings (tm1, tm2, . . . tm(n=1), tm(n), tm(n+1) . . . ) of one nozzle 30 when the ink-jet head 3 moves in one scanning direction are arranged sequentially, and the type of droplets to be jetted are associated with each of the jetting timings tm(n). In an example in FIG. 9, liquid droplets of M (medium droplets) are jetted at a certain jetting timing tm(n). Moreover, liquid droplets of S (small droplets) are jetted at a timing tm(n−1) prior to the jetting timing tm(n), and liquid droplets L (large droplets) are jetted at a jetting timing tm(n+1) subsequent to the jetting timing tm(n).

The second jetting mode memory circuit (or memory) 66 stores information related to seven types of second jetting modes which is more than the four types of the first jetting modes. Here, the information related to the seven second jetting modes is information for distinguishing a certain second jetting mode from the other second jetting modes. Concretely, the information related to the seven second jetting modes is information which indicates each of the seven second jetting modes is associated with one of the seven types of liquid droplets.

FIG. 10 is a diagram showing an association of the seven second jetting modes (from No. 0 to 6) and the types of the jetted liquid droplets, which are stored in the second jetting mode memory circuit 66. As shown in FIG. 10, the second jetting mode memory circuit 66 stores the seven second jetting modes upon associating the seven second jetting modes with the types of liquid droplets to be jetted (Nil (no liquid droplet jetting: volume of liquid droplets 0), S1 (small droplet 1), S2 (small droplet 2), M1 (medium droplet 1), M2 (medium droplet 2), L1 (large droplet 1), and L2 (large droplet 2)), respectively. Moreover, the volume of the liquid droplet (unit: p1) is set for each of the seven types of liquid droplets, and a relation of size of the droplets is Nil<S1<S2<M1<M2<L1<L2. In this manner, it is evident that in the second jetting mode, the types of the liquid droplets are subdivided further according to the volume of the liquid droplets, as compared to the first jetting mode shown in FIG. 8.

The jetting mode selecting circuit 67 determines a jetting mode at an arbitrary timing from among the second jetting modes, by referring to the first jetting modes associated with the arbitrary jetting timing, and another timing prior to the arbitrary jetting timing and still another timing subsequent to the arbitrary jetting timing (in other words, whether the type of liquid droplets is one of Nil, S. M, and L), included in the time-sequence information stored in the time-sequence information memory circuit 65.

FIGS. 11A and 11B indicate a table which is used in a jetting mode selection process by the jetting mode selecting circuit 67. In FIGS. 11A and 11B, a type of liquid droplets to be jetted at an arbitrary timing tm(n), a type of liquid droplets to be jetted at a jetting timing tm(n−1) immediately prior to the jetting timing tm(n), and a type of liquid droplets to be jetted at a jetting timing tm(n+1) immediately subsequent to the jetting timing tm (n) are shown. Moreover, it is also shown that the type of liquid droplet at the arbitrary timing tm(n) are converted from the types of liquid droplets (S, M, and L) of the first jetting mode to the types of liquid droplets (S1, S2, M1, M2, L1, and L2) of the second jetting mode.

Based on the first jetting modes (types of liquid droplets) at the jetting timing tm(n), the previous jetting timings tm(n−1) and the subsequent jetting timings tm(n+1), which are set in the time-sequence information, the jetting mode selecting section 67 selects (changes) the jetting mode at the jetting timing tm(n) among the second jetting modes such that a change of the liquid droplets of the three jetting timings tm(n−1), tm(n), and tm(n+1) become smooth. It is omitted in the diagram, but when the first jetting mode of at the jetting timing tm(n) set in the time-sequence information is a non-jetting mode of the liquid droplets (type of liquid droplet: Nil), a non-jetting mode of the liquid droplets (type of liquid droplet: Nil, No. 0) is selected from the second jetting modes in FIG. 10.

For instance, as shown in FIGS. 11A and 11B, when the type of liquid droplets of the first jetting mode associated with the jetting timing tm(n) is S, and when the liquid droplets are not jetted at the previous and subsequent jetting timing (type of liquid droplet: Nil), it is preferable that the type of liquid droplet jetted at the jetting timing tm(n) is as small as possible. Therefore, the jetting mode selecting circuit 67 selects the second jetting mode (No. 1) at which the smallest liquid droplet S1 (volume of liquid droplets 1 pl) is jetted, as the jetting mode at the jetting timing tm(n).

Moreover, when the type of liquid droplets of the first jetting mode associated with the jetting timing tm(n) is S, and when the type of liquid droplets at the jetting timing tm(n−1) immediately before the jetting timing tm(n) is L, a change in the volume of the liquid droplets between the continuous jetting timings is extremely large (L (volume of liquid droplets 10 pl)→S (volume of liquid droplets 1.5 pl)). Therefore, in such case, the jetting mode selecting circuit 67 selects a second jetting mode (No. 3) of jetting medium droplets M1 (volume of liquid droplets 3 pl) as the jetting mode at the jetting timing tm(n). In this case, a temporal change in the volume of the liquid droplets jetted continuously from one nozzle 30 becomes small as compared to a case in which the first jetting mode set in the time-sequence information is adopted (L→S). Accordingly, a difference in concentration is not so distinct, and an image quality is further improved.

When the processing by the jetting mode selecting circuit 67 is completed, the time-sequence information associating the second jetting mode with each jetting timing becomes data of 3 bit which enables to distinguish the seven second jetting modes. In other words, when input from the PC 59, the time-sequence information associating the first jetting mode with the jetting timing was data of 2 bit, and at this stage, is converted to data of 3 bit for associating with the second jetting mode.

In such manner, the time-sequence information of the second jetting mode associated with each jetting timing of all the nozzles 30 is transmitted to the driver IC 47. Moreover, as it has been described above, the driver IC 47 supplies a drive signal corresponding to the type of liquid droplets of the second jetting mode associated with each jetting timing to the actuator unit 7, and make jet the liquid droplets from the nozzle 30.

As it has been described above, the ink-jet printer 1 according to the first embodiment, selects the jetting mode at an arbitrary jetting timing according to a table in FIGS. 11A and 11B among the second jetting modes which are more in number (more gradations) than the first jetting modes, by referring to the first jetting mode (jetting history information) associated with the previous and the subsequent jetting timings included in the time-sequence information transmitted from the PC 59.

In other words, since the number of jetting modes (first jetting modes) associated with each jetting time according to the time-sequence information transmitted from the PC 59 which is an external apparatus is fewer (less) (four types) as compared to the number of second jetting modes (seven types) which is the final jetting mode, data of 2 bit for distinguishing the jetting mode serves the purpose, and an amount of data of the time-sequence information transmitted from the PC 59 is suppressed. Consequently, as compared to a case in which the time-sequence information of 3 bit corresponding to 7 steps of gradation is prepared at a PC 59 to transmit to the ASIC 54 of the ink-jet printer 54, smaller (fewer) amount of transmission data serves the purpose, and the transmission time becomes short.

Moreover, as the ASIC 54 does not acquire data of 3 bit from the PC 59 but converts the data to 3 bit on a half way, it is not necessary to carry out all the data processing in the ASIC 14 by 3 bit. Therefore, a structure (a configuration) of the ASIC 54 becomes comparatively simple, and smaller temporary storage area of the data to be stored serves the purpose. In other words, it is possible to express the multi-gradation by jetting selectively liquid droplets of larger number of types from one nozzle 30 while suppressing complications in the ASIC 54 and an increase in the storage area necessary for storing the processing data, and making a hard structure (structure of hardware) as simple as possible, and an image recording of high quality becomes possible.

Moreover, from a point of view of selecting the jetting mode at a jetting timing appropriately from among the seven second jetting modes, as shown in FIGS. 11A and 11B, it is preferable to refer to both of the first jetting modes at a jetting timing prior to and subsequent to the jetting timing.

Next, a modified embodiment in which various modifications are made in the first embodiment will be described below. However, same reference numerals are assigned to components which are similar as in the first embodiment, and the description of such components is omitted appropriately.

In the first embodiment, for determining the jetting mode at an arbitrary jetting timing, both of the first jetting modes at the jetting timings prior to and subsequent to the arbitrary jetting timing has been referred to. However, the jetting mode at the arbitrary jetting timing may be determined by referring to only the first jetting mode at one of the previous timing and the subsequent timing. In this case, there may be a small decline from a point of view of selecting more appropriately the jetting mode at the jetting time, but since only the jetting mode at one of the previous timing and the subsequent timing is to be referred to, a process of selecting the jetting mode becomes simple, and a circuit configuration of the ASIC which carries out the processing becomes simple.

In the embodiment, for determining the jetting mode at the arbitrary jetting timing, the type of liquid droplets at the previous jetting timing and the subsequent jetting timing have been referred to (refer to FIGS. 11A and 11B). However, the jetting mode at the arbitrary jetting timing may be determined based on whether or not the liquid droplets are jetted, at one of the previous and subsequent jetting timings or at both of the previous and subsequent jetting timings, without taking into considerations the type of liquid droplets.

For instance, as shown in FIG. 12, in a case of determining a jetting mode at a jetting timing tm(n) among the seven second jetting mode, a type of liquid droplets (one of Nil, S, M, and L) at the jetting timing tm(n−1) immediately before the jetting timing tm(n) and a presence or an absence of liquid droplet jetting at the jetting timing tm(n+1) immediately after the jetting timing tm(n) may be referred to.

The detail of the jetting mode selection process shown in FIG. 12 is given below. In the process shown in FIG. 12, as a rule, when the type of the liquid droplets in the first jetting mode at the jetting timing tm(n) is one of S, M, and L, and when the liquid droplet is to be jetted at the jetting timing tm(n+1) immediately after the jetting timing tm(n), then the second jetting mode which jets the liquid droplets of a larger type S2, M2, and L2 is to be selected respectively for making small a change in the volume of the liquid droplets to be jetted continuously. Whereas, when the liquid droplet is not to be jetted at the timing tm(n+1) immediately after the timing tm(n), the second jetting mode which jets the liquid droplets of a smaller type S1, M1, and L1 are selected respectively. However, when the type of liquid droplets in the first jetting mode at the jetting timing tm(n) is S, and when the type of liquid droplets at the jetting timing tm(n−1) immediately before the jetting timing tm(n) is L, then the second jetting mode at the timing tm(n) which jets the liquid droplets of a larger type M1 is to be selected irrespective of whether there is a jetting of liquid droplets at the jetting timing immediately after the jetting timing tm(n).

In the embodiment, for determining the jetting mode at a certain jetting timing tm(n), a first jetting mode/modes at a timing immediately before the jetting timing tm(n) and/or a jetting timing immediately after the jetting timing tm(n) has been referred to. However, a first jetting mode at a jetting timing even before the jetting timing tm(n−1) (for example, a jetting timing tm(n−2)) or a jetting timing even after the jetting timing tm(n+1) (for example, a jetting timing tm(n+2)) may be referred to.

The types of the first jetting mode and the second jetting mode (the numbers of the first and second jetting modes) are not restricted to the types indicated in the first embodiment, and can be changed appropriately within a range such that the types for the second jetting mode are more (larger in number) than the types for the first jetting mode.

In the first embodiment, the hardware such as ASIC converts the time-sequence information made of 2 bit data, which associates the four jetting modes to each jetting timing, to 3 bit data which associates the seven second jetting modes. However, it is possible to realize (execute) this conversion by software. In other words, it is possible to make a microcomputer perform a function same as the data generating circuit by a program for controlling jetting liquid droplet (a liquid-droplet jetting control program) stored in the ROM of the microcomputer being executed by the CPU.

In other words, when the program for controlling jetting the liquid droplets is executed by the CPU, the micro computer serves as (1) a first jetting mode memory which stores information related to the plurality of first jetting modes, (2) a time-sequence information memory which stores time-sequence information of jetting modes, associating one of the plurality of first jetting modes, for each jetting timing of a nozzle, (3) a second jetting mode memory which stores information related to the plurality of second jetting modes, and (4) a selector which selects the jetting mode at an arbitrary jetting timing among the plurality of second jetting modes by referring to the first jetting modes at the arbitrary jetting timing and at the jetting timing(s) immediately before and/or after the arbitrary jetting timing, included in the time-sequence information.

Even in this case, it is possible to increase the number of types of liquid droplets (types of the second jetting mode) jetting practically from each nozzle, while suppressing an increase in an amount of data of the time-sequence information, by reducing the number of types of the first jetting mode associated with each jetting timing according to the time-sequence information. Consequently, it is possible to suppress an increase in a capacity of a storage area which is necessary for storing the processing data, or an improvement in a performance of the CPU which executes the program.

Second Embodiment

In the first embodiment, according to a rule mentioned in the table in FIGS. 11A and 11B, the jetting mode at the jetting timing tm(n) is changed to one of the second jetting modes. In other words, the jetting mode at the jetting timing tm(n) is changed to one of the second jetting modes based on a relationship (combinations) of the first jetting modes (types of liquid droplets) at the jetting timing tm(n−1), tm(n), and tm(n+1). In a second embodiment, a control system similar to the control system in the first embodiment shown in FIG. 6 is used except when a computer (an arithmetic and logical unit) is used instead of the jetting mode selecting circuit 67 in the data generating circuit shown in FIG. 7. By using this computer, the second jetting mode at the jetting timing tm(n) is calculated as shown below based on the values (four values) of 2 bit at the jetting timing tm(n−1), tm(n), and tm(n+1). The first jetting mode is indicated by four values (0, 1, 2, and 3) as shown in first jetting mode No. Whereas, the second jetting No. 1 to 7 as shown in FIG. 13, are assigned to seven values (0, 0.5, 1.0, 1.5, 2.0, 2.5, and 3) in units of 0.5. Here, when the first jetting modes at the jetting timing tm(n−1), tm(n), and tm(n+1) are assigned to i(n−1), i(n), and i(n+1), respectively, and when the second jetting mode at the jetting timing tm(n) is assigned to j(n), the second jetting mode j(n) is calculated by a logical operation. The values (multi-values) which are available for i(n) and j (n) are shown in table 14.

Firstly, i(n−1) and i(n) are compared, and the following calculation (operation) is carried out for i(n) according to a comparison result, wherein when [i(n−1)−i(n)]≧1, then j(n) is assigned (modified) to be j(n)=i(n)+0.5;

when [i(n−1)−i(n)]=0, then j (n) is assigned to be j(n)=i(n); and when [i(n−1)−i(n)]≦−1, then j (n) is assigned to be j(n)=i (n)−0.5.

Next, i(n) and i(n+1) are compared, and the following calculation (operation) is carried for i(n) according to a comparison result, wherein when [i(n)−i(n+1)]≧1, then j (n) is assigned to be j(n)=i(n)−0.5;

when [i(n)−i(n+1)]≦0, then j(n) is assigned to be j(n)=i(n); and when [i(n)−i(n+1)]≦1, then j(n) is assigned to be j(n)=i (n)+0.5. In this manner, the calculation carried out by the result of comparison of i(n−1) and i(n), and the calculation carried by the result of comparison of i(n) and i(n+1) is performed for i(n).

For example, when i(n−1), i(n), and i(n+1) are 1, 0, and 1 respectively, firstly, since [i(n−1)−i(n)]≧1, 0.5 is added to i(n). Since [i(n−1)−i(n)]≦1, once again 0.5 is added to i(n). Consequently, j(n) becomes j(n)=i(n)+0.5+0.5=0+0.5+0.5=1.0. Moreover, when i(n−1), i(n), and i(n+1) are 1, 2, and 3 respectively, since [i(n−1)−i(n)]≦−1 and also [i(n)−i(n+1)]≦−1, j (n) becomes j(n)=2−0.5+0.5=2. In this manner, when i(n) is compared with the previous and the subsequent values (i(n−1) and i(n+1)), and when i(n) is larger (higher) by 1 or more, 0.5 is subtracted from i(n), and when i(n) is smaller (lower) by 1 or more, 0.5 is added to i(n). By doing so, a difference between i(n) and the previous and the subsequent values (i(n−1) and i(n+1)) becomes small, and a fluctuation between the three values i(n−1), i(n), and i(n+1) becomes small.

In the abovementioned example of calculation (operation), i(n) is compared with the previous and the subsequent values (i(n−1) and i(n+1)). However, i(n) may be compared with only the previous value i(n−1). Even in this case, it is possible to find j(n) by using the following rule when [i(n−1)−i(n)]≧1, then j(n) is assigned to be j(n)=i (n)+0.5;

when [i(n−1)−i(n)]=0, then j(n) is assigned to be j(n)=i(n); and when [i(n−1)−i(n)]≦−1, then j(n) is assigned to be j(n)=i (n)−0.5.

Alternatively, i(n) may be compared with only the subsequent value i(n+1). In this case, it is possible to use the following rule;

when [i(n)−i(n+1)]≧1, then j(n) is assigned to be j(n)=i (n)−0.5;

when [i(n)−i(n+1)]=0, then j(n) is assigned to be j(n)=i(n); and when [i(n)−i(n+1)]≦−1, then j(n) is assigned to be j(n)=i (n)+0.5.

By carrying out the calculation (operation) according to the abovementioned rules, it is possible to convert the four values of i(n) to the seven values of j(n), However, j(n) is not restricted to seven values, and may be multi-values not less than five values, such as six values or eight values. A case in which j(n) has eight values will be described below with reference to FIGS. 15 and 16. When a type of liquid droplets of volume of 2 (pl) is added between the liquid droplets of volume of 1.5 (pl) and 3 (pl) in the table in FIG. 10, it is possible to subdivide into eight types of liquid droplets as shown in FIG. 15 (in this case, medium droplets have three types). When the j value namely 0, 1, 2, 3, 4, 5, 6, and 7 (or 3 bit value) as shown in FIGS. 15 and 16 are assigned to such eight types of liquid droplets, respectively, and when the calculation is carried out such that the difference between the i(n) and the previous and the subsequent values (i(n−1) and i(n+1)) thereof becomes small, then it is possible to calculate (find) j(n). For instance, a calculation such as the following can be cited as an example.

Firstly, i(n−1) and i(n) are compared, and the following calculation (operation) is carried out according to a comparison result;

wherein when [i(n−1)−i(n)]≧1, then j(n) is assigned to be j(n)=2i(n)+1;

when [i(n−1)−i(n)]=0, then j(n) is assigned to be j(n)=2i (n); and when [i(n−1)−i(n)]≦−1, then j (n) is assigned to be j(n)=2i (n)−1.

Next, i(n) and i(n+1) are compared, and the following calculation (operation) is carried for i(n) according to a comparison result;

wherein when [i(n)−i(n+1)]≧1, then j(n) is assigned to be j(n)=i(n)−0.5;

when [i(n)−i(n+1)]=0, then j(n) is assigned to be j(n)=i(n); and when [i(n)−i(n+1)]≦−1, then j (n) is assigned to be j(n)=i (n)+0.5.

However, even when [i(n−1)−i(n)]≧1 and [i(n)−i(n+1)]≦−1, at the time of calculating j (n), only a number "1.0" at the maximum is added to 2i(n) (adding "2.0" is forbidden, in this case). Similarly, even when [i(n−1)−i(n)]≦−1 and [i(n)−i(n+1)]≧1, at the time of calculating j(n), only a number "1.0" at the maximum is subtracted from 2i(n) (subtracting "2.0" is forbidden, in this case). This condition has been imposed upon taking into consideration an original value of i(n) (signal data), for preventing i(n) from changing substantially from the original value.

When the calculation (operation) is carried out under the imposed condition, for instance, when a set of i(n−1), i(n) and i(n+1) is 1, 0, and 1, respectively, then, [i(n−1)−i(n)]≧1 and [i(n)−i(n+1)]≦1. Therefore, j(n) becomes j(n)=2×0+1=1. For example, when the set of i(n−1), i(n), and i(n+1) is 1, 3, and 2, respectively, then, [i(n−1)−i(n)]≦1 and [i(n)−i(n+1)]>1. Therefore, j(n) becomes j(n)=2×3−1=5. The volume of the liquid droplets when i(n)=3 originally, was 10 pl as shown in the table in FIG. 8. However, it is evident that the volume of the liquid droplets corresponding to j(n)=5 is reduced to 5 pl (refer to table in FIG. 15), upon taking into consideration the volume of the liquid droplets at the previous and the subsequent jetting timing (1.5 pl and 3 pl).

In the second embodiment, an example of a case in which an input multi-valued signal i(n) to the computer has four values, and a multi-valued signal after the calculation by the computer has seven values or eight values. Without restricting to this, it is possible to let the input signal to have more or less than four values such as two values, three values, five values and more. Moreover, it is possible to let j(n) and i(n) to be arbitrary multi-values, and it is possible to improve resolution by letting to be nine values, ten values, . . . sixteen values for having even more favorable gradation.

The abovementioned processing in the second embodiment has been carried out by a computer. However, the processing may be carried out by a CPU of a printer. Moreover, in the second embodiment, it is possible to omit the first jetting mode memory circuit 64 and the second jetting mode memory circuit 66. Furthermore, the time-sequence information circuit may be formed of a memory or a shift register.

In the first and second embodiments, the image processing of image data is carried out in the PC which is an external apparatus, and the time-sequence information which associates one of the four first jetting modes to each jetting timing is generated in the PC 59, and is transmitted to the ASIC 54 of the printer. However, an arrangement may be made such that the time-sequence information is generated by the printer. For instance, when an image storage medium in which image data is stored is directly connected to a printer without being connected through an external apparatus such as PC, and when the printer records an image stored in the image storage medium on a recording paper P, then it is necessary to generate the time-sequence information at a printer side.

As it has been described above, when both the generation of the time-sequence information and the selection of the jetting mode based thereon are carried out by the printer independently, there is no advantage of reducing an amount of data transmitted to the printer from the external apparatus by reducing the types of the first jetting modes becoming small, unlike in the first and embodiment and the second embodiment. However, even in this case, the amount of the time-sequence information, handled by ASIC which carries out various processing related to image recording by hardware or by a microcomputer which carries out processing by software, becomes small (such as 2 bit) partially. Therefore, there is an effect that it is possible to suppress an increase in a capacity of a storage area which is necessary for storing the processing data, or an improvement in a performance of the CPU and complicating of the ASIC.

In the embodiments and the modified embodiments thereof described above, the present invention is applied to an ink-jet printer which records an image etc. by jetting an ink on to a recording paper. However, the application of the present invention is not restricted to an apparatus which is used only for such application. In other words, the present invention is also applicable to various liquid droplet jetting apparatuses which jet various types of liquids other than ink on to an object (subjected to jetting) according to that application.

What is claimed is:

1. A liquid droplet jetting apparatus which jets a droplet of a liquid from a nozzle in a plurality of jetting modes, selectively, which are different from each other in a volume of the droplet, the apparatus comprising:

a first jetting mode memory which stores information about a plurality of first jetting modes;

a time-sequence information memory which stores time-sequence information of the first jetting modes, which is associated, for each of jetting timings of the nozzle, with one of the first jetting modes stored in the first jetting mode memory;

a second jetting mode memory which stores information about a plurality of second jetting modes of which number is more than that of the plurality of first jetting modes; and a jetting mode selector which selects, at a certain jetting timing, a second jetting mode among the plurality of second jetting modes stored in the second jetting mode memory, based on one first jetting mode associated with the certain jetting timing and another first jetting mode associated with a successive jetting timing which is at least one of previous and subsequent jetting timings of the certain jetting timing, included in the time-sequence information stored in the time-sequence information memory, wherein the jetting mode selector selects, at the certain jetting timing, the second jetting mode among the plurality of second jetting modes, such that a difference in the volume of the droplet between the second jetting mode at the certain jetting timing and the first jetting mode at the successive jetting timing is less than that between the first jetting mode at the certain jetting timing and the first jetting mode at the successive jetting timing.

2. The liquid droplet jetting apparatus according to claim 1 further comprising:

a memory storing a table indicating a relationship between combinations of the one first jetting mode associated with the certain jetting timing and the another first jetting mode associated with the successive jetting timing, and second jetting modes which are previously determined, respectively, corresponding to the combinations, wherein the second jetting mode at the certain jetting timing is selected among the plurality of second jetting modes based on the table.

3. The liquid droplet jetting apparatus according to claim 1, wherein the time sequence information memory stores the time-sequence information transmitted from an external apparatus which is communicably connected to the liquid droplet jetting apparatus.

4. The liquid droplet jetting apparatus according to claim 1, wherein the plurality of first jetting modes include a non-jetting mode in which the droplet is not jetted and a jetting mode in which the droplet is jetted, and the jetting mode selector selects, at the certain jetting timing, the second jetting mode among the plurality of second jetting modes, based on whether or not the droplet is jetted at the successive jetting timing.

5. The liquid droplet jetting apparatus according to claim 1, wherein the jetting mode selector selects, at the certain jetting timing, the second jetting mode among the plurality of second jetting modes, based on both of a first jetting mode associated with the previous jetting timing and another first jetting mode associated with the subsequent jetting timing.

6. The liquid droplet jetting apparatus according to claim 1, further comprising a jetting head in a surface of which the nozzle is formed and a driving unit which drives the jetting head, wherein a drive signal corresponding to the second jetting mode at the certain jetting timing which is selected among the plurality of second jetting modes is transmitted to the driving unit.

7. The liquid droplet jetting apparatus according to claim 1, wherein the jetting mode selector selects, at the certain jetting timing, the second jetting mode among the plurality of second jetting modes stored in the second jetting mode memory, based on one first jetting mode associated with the certain jetting timing and other first jetting modes associated with successive jetting timings including a previous jetting timing and a subsequent jetting timing of the certain jetting timing, included in the time-sequence information stored in the time-sequence information memory.

8. A non-transitory computer readable medium storing a program for controlling jetting a liquid droplet which causes the droplet to be jetted from a nozzle in a plurality of jetting modes, selectively, which are different from each other in a volume of the droplet, the program making a computer operate as:

a first jetting mode memory which stores information about a plurality of first jetting modes;

a time sequence information memory which stores time-sequence information of the first jetting modes which is associated with, for each of jetting timings of the nozzle, one of the first jetting modes stored in the first jetting mode memory;

a second jetting mode memory which stores information about a plurality of second jetting modes of which number is more than that of the plurality of first jetting modes; and a jetting mode selector which selects, at a certain jetting timing, a second jetting mode among the plurality of second jetting modes stored in the second jetting mode memory, based on one first jetting mode associated with the certain jetting timing and another first jetting mode associated with successive jetting timing which is at least one of previous and subsequent jetting timings of the certain jetting timing, included in the time-sequence information stored in the time-sequence information memory, wherein the jetting mode selector selects, at the certain jetting timing, the second jetting mode among the plurality of second jetting modes, such that a difference in the volume of the droplet between the second jetting mode at the certain jetting timing and the first jetting mode at the successive jetting timing is less than that between the first jetting mode at the certain jetting timing and the first jetting mode at the successive jetting timing.

9. The non-transitory computer readable medium according to claim 8, wherein the jetting mode selector selects, at the certain jetting timing, the second jetting mode among the plurality of second jetting modes stored in the second jetting mode memory, based on one first jetting mode associated with the certain jetting timing and other first jetting modes associated with successive jetting timings including a previous jetting timing and a subsequent jetting timing of the certain jetting timing, included in the time-sequence information stored in the time-sequence information memory.

* * * * *